US006085554A

United States Patent [19]

Apollonio

[11] Patent Number: 6,085,554

[45] Date of Patent: Jul. 11, 2000

[54] LOOP TRANSFER NEEDLE FOR A CIRCULAR KNITTING MACHINE

[75] Inventor: Francesco Gavagnin Apollonio, Hickory, N.C.

[73] Assignee: Edelweiss Manufacturing Co., Inc., Hickory, N.C.

[21] Appl. No.: 09/241,416

[22] Filed: Feb. 2, 1999

[51] Int. Cl.[7] ..... D04B 35/02

[52] U.S. Cl. ..... 66/123; 66/121; 66/116; 66/8

[58] Field of Search ..... 66/8, 30, 13, 37, 66/46, 51, 95, 116, 120, 123, 121

[56] References Cited

U.S. PATENT DOCUMENTS

| | | | |
|---|---|---|---|
| 2,060,020 | 11/1936 | Boaler . | |
| 2,076,896 | 4/1937 | Jones et al. . | |
| 2,188,125 | 1/1940 | Wigley . | |
| 2,292,940 | 8/1942 | Holmes et al. . | |
| 2,780,082 | 2/1957 | Zeruneith . | |
| 2,953,914 | 9/1960 | Zeruneith . | |
| 2,997,865 | 8/1961 | Philp . | |
| 3,084,528 | 4/1963 | Philip . | |
| 3,110,167 | 11/1963 | Parthum . | |
| 3,225,569 | 12/1965 | Luchi . | |
| 3,470,715 | 10/1969 | Parthum . | |
| 3,508,420 | 4/1970 | Parthum et al. . | |
| 3,584,481 | 6/1971 | Hayashi | 66/120 |
| 3,609,998 | 10/1971 | Mutze et al. . | |
| 3,613,399 | 10/1971 | Fecker . | |
| 3,636,730 | 1/1972 | Fecker . | |
| 3,800,560 | 4/1974 | Hanney et al. . | |
| 3,838,583 | 10/1974 | Rumi et al. . | |
| 4,005,589 | 2/1977 | Uhlíř . | |
| 4,612,786 | 9/1986 | Perotti | 66/121 |

FOREIGN PATENT DOCUMENTS

| | | |
|---|---|---|
| 1246-449 | 10/1989 | Japan . |
| 446670 | 4/1936 | United Kingdom . |

*Primary Examiner*—Larry Worrell
*Attorney, Agent, or Firm*—Adams Law Firm, P.A.

[57] ABSTRACT

A needle for a circular knitting machine wherein loops can be transferred from one needle to an adjacent needle for forming decorative patterns of open-work. The needle includes an elongate shank having a hook formed on a top end thereof and a butt formed on a bottom end thereof. A latch is pivotally mounted on the shank below said hook and reciprocally moveable by a yarn being formed into a loop between an open position wherein the latch resides generally alongside the shank of the needle and a closed position extending between the shank and the end of the hook. A loop deflector is positioned on the needle shank between the latch and the butt and extends laterally into a plane defined an adjacent needle for receiving the adjacent needle through the loop whereby the loop is transferred laterally to the adjacent loop to thereby form an opening in the fabric being formed by the knitting machine.

9 Claims, 2 Drawing Sheets

LOOP TRANSFER NEEDLE FOR A CIRCULAR KNITTING MACHINE

TECHNICAL FIELD AND BACKGROUND OF THE INVENTION

This invention relates to needles for circular knitting machines capable of manufacturing hosiery and like articles. More particularly, the invention relates to needles useful in a stitch or loop transfer operation for creating hosiery having decorative patterns of openings formed therein.

Circular knitting machines carry out knitting operations which form multiple strands of yarn into a tubular form. Such machines can form yarn into knitted fabrics useful for many different products, dependent on, for example, the circumference of the machine cylinder, the gauge and size of needles. One typical application is the production of hosiery, such as socks, hose and stockings. Such machines include a plurality of needles positioned in axial slots formed in an exterior surface of a rotatable needle cylinder. A plurality of sinkers are mounted between the needles to hold the knitted loops. A feeder mechanism delivers yarn onto the passing needles in succession. The yarn forms loops over each needle in a controlled manner.

Patterns of open areas in circular knitted fabric formed by dropping stitches in a controlled manner. Heretofore, the formation of open-work pattern designs has been limited to relatively coarse gauge machines because of the difficulty in transferring a loop from one needle to an adjacent needle to thus form the opening in a controlled, reliable manner on fine gauge hosiery machines.

In other applications, transfer of the stitch may be accomplished to prevent running or "laddering" of hosiery products.

In the particular embodiment shown in this application for purposes of illustration, the knitting machine is a circular knitting machine of the type used for knitting hosiery. In this type of machine, the garment, as knitted, is held under tension in the throat of the cylinder. The pattern may be controlled by any type of patterning device, such as known electronic, electro-mechanical or mechanical devices.

Any type of knitting machine may be modified according to the general principles of this application, provided the stitches are otherwise capable of being transferred from one needle to another.

Creation of patterns in knitted articles by transferring stitches from one needle to another is known in the prior art. In one prior art knitting machine, the knitting needles of the machine are separated by transfer members which reside in and move in the same vertical plane as the knitting needles and therefore separate the needles at all times. This limits the gauge of the fabrics which can be knitted with this type of machine since the diameter of the machine must accommodate both the knitting needles and the transfer members. For this reason, it has heretofore been impractical to knit fine hosiery with intricate, decorative patterns formed by transferring stitches.

Another prior art device uses a dial plate eccentric with respect to the needle cylinder and defines with the needle cylinder an enlarged loop transfer zone. The dial plate includes horizontally-disposed punches which facilitate transfer of loops from the certain needles of the needle cylinder onto adjacent needles.

A transfer stitch operation involves transferring a stitch from a selected needle to a following needle. As used herein, a selected needle is a needle from which the transfer stitch is removed, and a following needle is an adjacent needle to which the transfer stitch is placed. To perform the transfer stitch operation, the stitch on the selected needle is enlarged or widened. Once the stitch on the selected needle is sufficiently enlarged, the following needle is inserted through the enlarged stitch such that the stitch can then be secured around the following needle. Finally, the selected needle is removed from the enlarged stitch thereby causing the selected needle to release the stitch. As a result, the stitch is completely transferred from the selected needle to the following needle and a controlled perforation is formed in the hosiery article being created. A pattern of perforations can be formed in the hosiery article by selecting needles in accordance with a pre-determined set of instructions.

Prior art devices transfer the stitch from one needle to another needle by first removing the stitch from one needle and then placing it onto the adjacent needle. This practice increases the likelihood of missed transfers and other defects in the finished product.

Because the stitches on a selected needle must be enlarged before they are transferred to an adjacent needle, a considerable amount of tension is exerted on the yarn. As a result, it is quite possible that the yarn will break during the transfer stitch operation. A broken yarn, like a run, makes the article being formed unusable. There exists a need for a needle that minimizes the tension on the yarn during the transfer stitch operation necessary to form decorative open-work in hosiery and other knitted products.

Another impediment to performing the transfer stitch operation is the limited space between and around needles. This problem is also accentuated by the presence of the sinkers between the needles which affect the orientation and size of the opening created when the stitches are enlarged. In addition to the need to minimize the tension on the yarn, the lack of space available between and around the needles greatly reduces the extent to which the stitches can be enlarged. As a result of these limitations to enlarging a selected stitch, adjacent needles entering an enlarged stitch have little room for error lest the adjacent needle not enter the enlarged stitch. This results in the stitch being dropped and a run being formed in the hosiery article being created.

SUMMARY OF THE INVENTION

Therefore, it is an object of the invention to provide a needle capable of performing the transfer stitch operation by properly positioning the enlarged stitch with respect to the following needle to ensure error free transfers.

It is another object to provide a way of transferring a knitting stitch or loop from one needle to another needle in a controlled manner by placing the stitch on the new needle before removing it from the old one.

A further and more particular object of the invention is to provide a needle for virtually error-free transferring of a stitch from a selected needle to a following needle on a circular knitting machine operating 120 needles or more mounted in a needle cylinder having a diameter of 3.5 inches or less.

It is another object of the invention to provide a needle which is capable of achieving spacings of as little as 1 mm between needles.

Another object of the invention is to provide a needle having means for reducing the tension on the yam when the stitch is enlarged.

Another object of the invention is to provide a needle having means for preventing the stitch from traveling down below the deflector of the selected needle.

Another object of the invention is to provide a needle having means for favoring the entry of the following needle through the enlarged stitch on a selected needle.

The present invention is a circular knitting machine needle capable of performing virtually error-free transfer stitches to create hosiery articles having a pattern of small perforations. The needle according to the invention includes an elongate shank having opposed top and bottom ends. A hook is formed in a top end of each needle shank and a butt is formed in a bottom end of each needle shank. Each needle preferably has a latch mounted on the needle shank below the hook. The latch pivots between a hook closed position in which the distal end of the latch abuts the distal end of the hook and a hook open position in which the latch abuts the shank of the needle and is distally disposed with respect to the hook. When a needle is positioned in the axial groove of a needle cylinder, the hook and latch of each needle are aligned in a radially outwardly manner with respect to the needle cylinder, and the butts formed in the bottom end of each needle extend radially outwardly beyond the circumference of the needle cylinder.

The needle includes a stitch-enlarging means positioned on the needle shank at a point below the latch. In a preferred embodiment, the stitch-enlarging means is a deflector integrally formed with and extending laterally from the needle shank at a location below the latch. The deflectors are generally delta shaped, sharing a common edge with the needle shank and increasing in width from top to bottom. The distal region of each deflector extends beyond the plane of the shank of an adjacent needle. Finally, the deflectors initially extend radially outwardly, but they then curve radially inwardly toward the longitudinal axis of the needle cylinder.

During the stitch transfer operation, the selected needle rises upwardly causing the stitch on that needle to slide down the needle shank. The stitch eventually encounters the deflector. As the stitch slides down the sloping edge of the deflector, the stitch is enlarged.

In accordance with the present invention, means for retaining a stitch, such as a catch, is preferably formed in the distal region of each deflector. The stitch-retaining means limits downward movement of an enlarged stitch to prevent the stitch from moving down below the deflector. When the stitch is caught by the stitch-retaining means, the stitch is enlarged beyond the plane of the following needle. Also, a recess is preferably formed in the shank of the needle proximate to the deflector. The recess reduces the tension on the yarn by reducing the size of the enlarged stitch. The recess preferably has a semi-circular shape having an apex in alignment with the stitch-retaining means.

Finally, an extension is formed in the top surface of the hook to facilitate entry of the following needle through the stitch enlarged by the deflector on the selected needle. The extension is preferably pointed and slanted in the direction of the enlarged stitch. Consequently, the probability that the following needle will miss entering an enlarged stitch is significantly reduced.

It is contemplated by the present invention that the needles may have either a left-hand or a right-hand orientation. Therefore, a stitch can be transferred from a selected needle to a following needle immediately preceding the selected needle with respect to the direction of needle cylinder rotation or a stitch can be transferred from a selected needle to a following needle immediately succeeding needle with respect to the direction of needle cylinder rotation.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
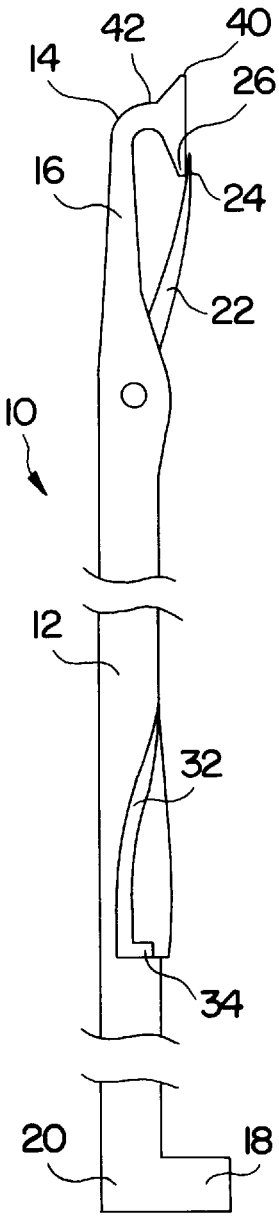
FIG. 1 is a side view of a preferred embodiment of a circular knitting machine needle according to the invention.
Figure 2:
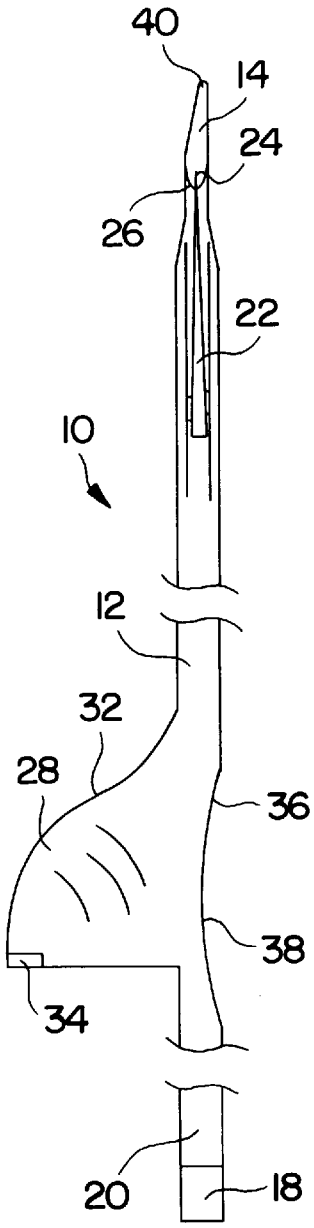
FIG. 2 is a front view of the needle of FIG. 1.
Figure 3:
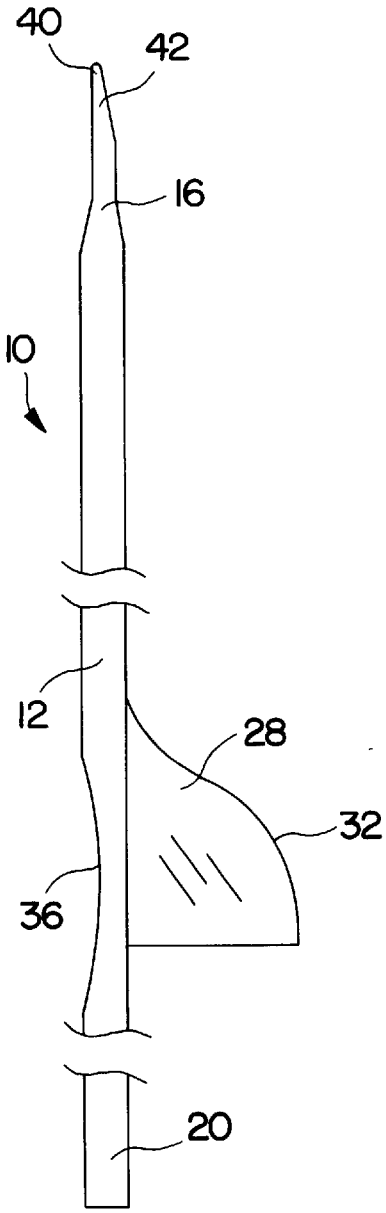
FIG. 3 is a rear view of the needle of FIG. 1.
Figure 4:
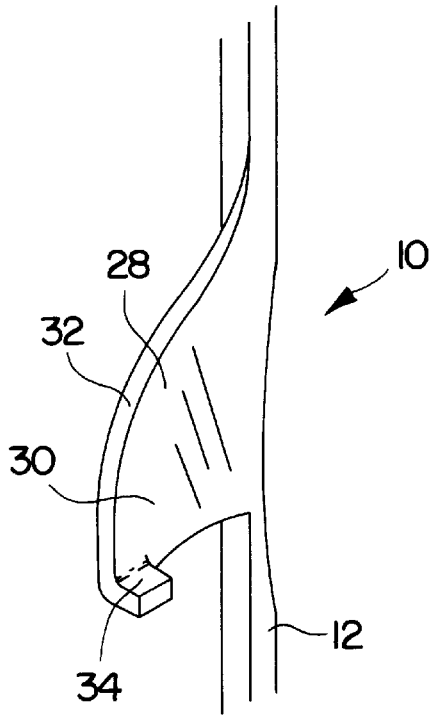
FIG. 4 is a close-up view of a preferred deflector having stitch-retaining means.
Figure 5:
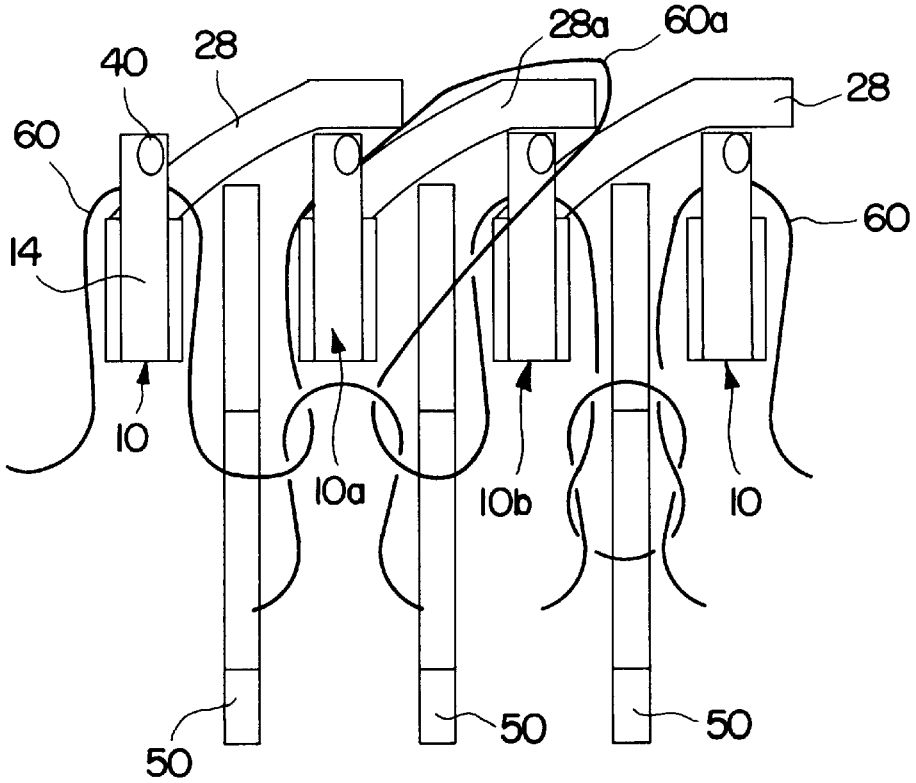
FIG. 5 is a top view of several needles and sinkers.

Referring now specifically to the drawings, a knitting needle according to the present invention is illustrated in FIGS. 1, 2 and 3 and shown generally at reference numeral 10. A plurality of needles 10 are mountable in axial grooves formed in an exterior surface of a hollow needle cylinder (not shown). The needles 10 are equidistantly spaced in a circular pattern around the circumference of the needle cylinder. As shown in FIG. 5, sinkers 50 are alternately positioned between the needles.

Each needle 10 includes an elongate shank 12 having opposed top and bottom ends. A hook 14 is formed in the top end 16 of the needle shank 12, and a butt 18 is formed in the bottom end 20 of the needle shank 12. Below the hook 14, a latch 22, pivotally attached to the needle shank 12, opens and closes the hook 14. The latch 22 pivots between a hook closed position in which the distal end 24 of the latch 22 abuts the distal end 26 of the hook 14 and a hook open position in which the latch 22 abuts the needle shank 12 and is distally disposed with respect to the hook 14. In the closed position, a knitted loop is permitted to be released by sliding over the top of the hook 14 of the needle 10. In the open position, the yarn is caught by the hook 14 in order to form loop and pull it through a previously-formed loop, thus making a stitch.

As is commonly the case, the hook 14 and latch 22 are radially aligned with respect to the needle cylinder. As shown in FIGS. 1–4, a loop deflector 28 is integrally formed with and extends laterally outwardly from the needle shank 12 at a point below the latch 22. The deflectors 28 are generally delta shaped, having a smooth, progressively-increasing dimension as it extends towards the butt 18. Deflector 28 share a common edge with the needle shank 12. As shown in FIG. 5, a distal region 30 of each deflector 28 extends beyond the plane of the shank of an adjacent needle 10. The deflectors 28 initially extend radially outwardly, but then curve radially inwardly toward the center of the needle cylinder.

The needles 10 form knitting stitches from yams in a cycle that begins in a feeder zone where a feeder mechanism (not shown), drawing from multiple spools (not shown), continuously delivers yam onto each needle 10. Initially, the latches 22 on the needles 10 are in the hook open position such that the strands of yam form loops or stitches 60 around the hooks 14 of the needles 10. The stitches 60 are held in position by the sinkers 50. The latches 22 are then moved to the hook closed position in a conventional manner by cams, thereby securing the stitches 60 in the hooks 14. Stitch transfer takes place where stitches 60*a* on selected needles 10*a* are transferred to following needles 10*b*.

During the stitch transfer operation, the selected needle 10*a* is raised upwardly by a cam, causing the stitch 60*a* on that needle 10*a* to slide down the needle shank 12. The stitch 60*a* eventually encounters the deflector 28*a*. As the stitch 60*a* slides down the sloping edge 32 of the deflector 28, the stitch 60*a* is enlarged in a lateral dimension over into an area in the plane of the adjacent needle 10*b*.

As shown in FIGS. 1–4, loop retaining mean comprising a catch 34 is formed in the distal region 30 of each deflector 28. The catch 34 limits downward movement of an enlarged stitch 60*a* to prevent the stitch 60*a* from moving down below the deflector 28 and onto the shank 12 of the needle 10. When the stitch 60*a* is held by the catch 34, the stitch 60*a* is enlarged beyond the plane of the shank 12 of the following needle 10*b*, as shown in FIG. 5.

A concave recess 36 is preferably formed in the shank 12 of the needle 10 opposite to the deflector 28. The recess 36 reduces the tension on the yarn reducing the amount of yarn needed to form the enlarged stitch 60A and thus reducing the size of an enlarged stitch 60*a*. The recess 36 preferably arcuate in shape.

The needle 10 includes an extension 40 formed in the top surface 42 of the needle hook 14. The extension 40 facilitates the entry of the following needle 10*a* by reducing the profile of the needle 10 which must fit through the enlarged loop.

A knitting needle is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A needle for performing a transfer stitch operation on a circular knitting machine, comprising:

(a) an elongate shank having a hook formed on a top end thereof and a butt formed on a bottom end thereof;

(b) a latch pivotally mounted on the shank below said hook and reciprocally moveable by a yarn being formed into a loop between an open position wherein the latch resides generally alongside the shank of the needle and a closed position extending between the shank and the end of the hook;

(c) an extension formed on said hook, said extension having a reduced profile and extending upwardly from said hook for penetrating the loop formed for transfer; and (d) loop-enlarging means positioned on the needle shank between the latch and the butt and extending laterally into a plane defined by an adjacent needle for receiving the adjacent needle through the loop whereby the loop is transferred laterally to the adjacent loop to thereby form an opening in a fabric being formed by the knitting machine.

2. A needle according to claim 1, wherein said loop-enlarging means comprises a loop deflector integrally-formed with said needle shank and having a progressively increasing laterally-extending dimension towards the butt end of the needle for enlarging the loop as the needle moves upwardly relative to the loop.

3. A needle according to claim 2, and including loop retaining means formed on a distal portion of said deflector for retaining the loop on the deflector during loop transfer.

4. A needle according to claim 1, and including a recess formed in the shank of the needle in opposing alignment with the loop-enlarging means for reducing the amount of yarn needed to form the enlarged loop.

5. A needle according to claim 1, wherein said extension has a pointed upper projection.

6. A needle according to claim 1, wherein said extension extends obliquely out of the plane of the shank towards an adjacent needle.

7. A circular knitting machine needle for performing a transfer stitch operation, comprising:

an elongate shank having opposed top and bottom ends;

a hook formed in said top end of said shank;

an extension formed on said hook, said extension having a reduced profile and extending upwardly from said hook;

a latch pivotally mounted on said shank below said hook;

a butt formed in said bottom end of said shank;

stitch-enlarging means positioned on said shank below said latch; and a recess formed in said shank proximate to said stitch enlarging means.

8. The needle of claim 7 further comprising means for retaining a stitch in a desired position to permit insertion of a following needle through a stitch enlarged by said stitch enlarging means of a selected needle.

9. A needle for performing a transfer stitch operation on a circular knitting machine, comprising:

(a) an elongate shank having a hook formed on a top end thereof and a butt formed on a bottom end thereof;

(b) a latch pivotally mounted on the shank below said hook and reciprocally moveable by a yarn being formed into a loop between an open position wherein the latch resides generally alongside the shank of the needle and a closed position wherein the latch extends between the shank and the end of the hook;

(c) an extension formed on said hook, said extension having a reduced profile and extending upwardly from said hook for penetrating the loop formed for transfer;

(d) loop-enlarging means comprising a loop deflector positioned on the needle shank between the latch and the butt and extending laterally into a plane defined by an adjacent needle for receiving the adjacent needle through the loop whereby the loop is transferred laterally to the adjacent loop to thereby form an opening in a fabric being formed by the knitting machine;

(e) loop retaining means formed on a distal portion of said deflector for retaining the loop on the deflector during loop transfer; and (f) a recess formed in the shank of the needle in opposing alignment with the loop-enlarging means for reducing the amount of yarn needed to form the enlarged loop.

* * * * *